US006894670B2

(12) United States Patent
Funakoshi et al.

(10) Patent No.: US 6,894,670 B2
(45) Date of Patent: May 17, 2005

(54) IMAGE DISPLAY APPARATUS AND METHOD THEREOF

(75) Inventors: Akihiro Funakoshi, Kamakura (JP); Toshio Shimizu, Sagamihara (JP)

(73) Assignee: International Business Machines Corporation, Armonk, NY (US)

( * ) Notice: Subject to any disclaimer, the term of this patent is extended or adjusted under 35 U.S.C. 154(b) by 185 days.

(21) Appl. No.: 09/681,534

(22) Filed: Apr. 24, 2001

(65) Prior Publication Data

US 2001/0033262 A1 Oct. 25, 2001

(30) Foreign Application Priority Data

Apr. 24, 2000 (JP) ..... 2000-123033

(51) Int. Cl.[7] ..... G09G 3/36

(52) U.S. Cl. ..... 345/89; 345/50; 345/54; 345/55; 345/87; 345/90

(58) Field of Search ..... 345/89–90, 50, 345/54–55, 87

(56) References Cited

U.S. PATENT DOCUMENTS 5,245,327 A * 9/1993 Pleva et al. ..... 345/600
5,428,465 A * 6/1995 Kanamori et al. ..... 358/518
5,521,987 A * 5/1996 Masaki ..... 382/218
5,576,723 A * 11/1996 Asprey ..... 345/3.1
5,859,633 A * 1/1999 Kim ..... 345/211
6,118,413 A * 9/2000 Bril et al. ..... 345/596
6,198,469 B1 * 3/2001 Tjandrasuwita ..... 345/690
6,362,834 B2 * 3/2002 Ishii ..... 345/690
6,466,225 B1 * 10/2002 Larkin et al. ..... 345/596

* cited by examiner

*Primary Examiner*—Vijay Shankar
*Assistant Examiner*—Leonid Shapiro
(74) *Attorney, Agent, or Firm*—Derek S. Jennings; David Aker

(57) ABSTRACT

A liquid crystal display apparatus for displaying an image on a liquid crystal cell through a liquid crystal driver driven by a predetermined number of bits by inputting image data in which one pixel is represented with a plurality of sub-pixels. The liquid crystal display apparatus includes: memory for storing information about an offset for converting gray level coordinates of a gamma characteristic spaced evenly according to the number of bits into gray level coordinates spaced unevenly; a gray level adjustment portion for performing a calculation on particular input sub-pixel data based on information about the offset stored in the memory; and a pseudo-gray-level-expansion portion for applying pseudo gray level expansion to the sub-pixel data calculated by the gray level adjustment portion. The sub-pixel data to which the pseudo gray level expansion is applied by the pseudo-gray-level-expansion portion is supplied to the liquid crystal driver to display the image on the liquid crystal cell.

12 Claims, 7 Drawing Sheets

[Figure 1]
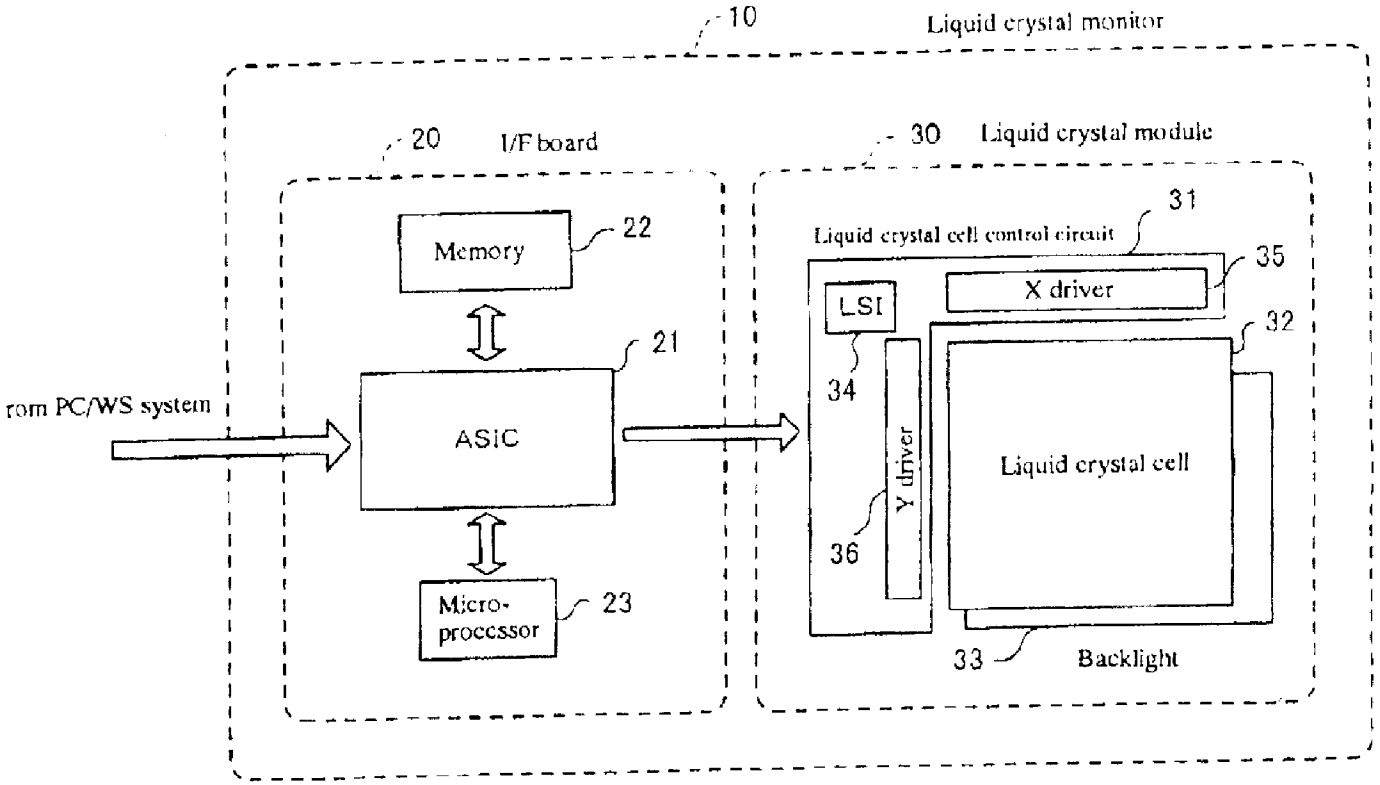

[Figure 2]
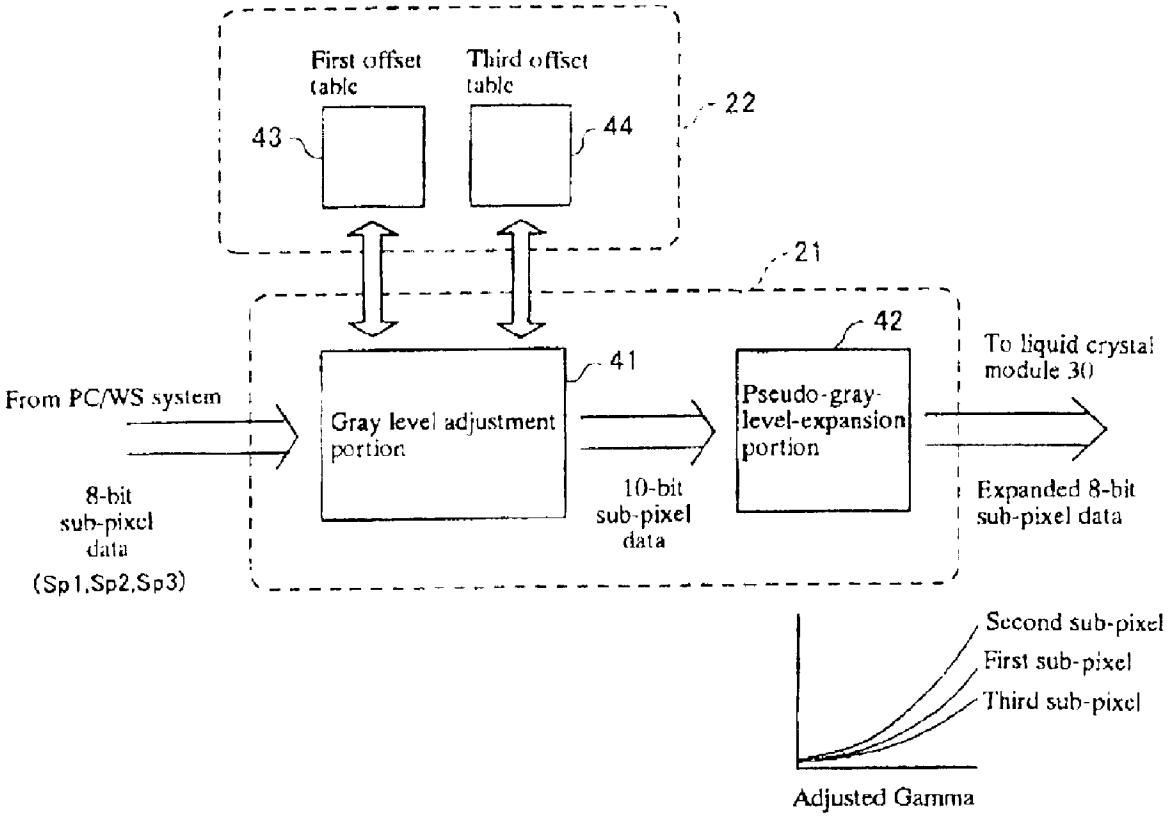

[Figure 3]
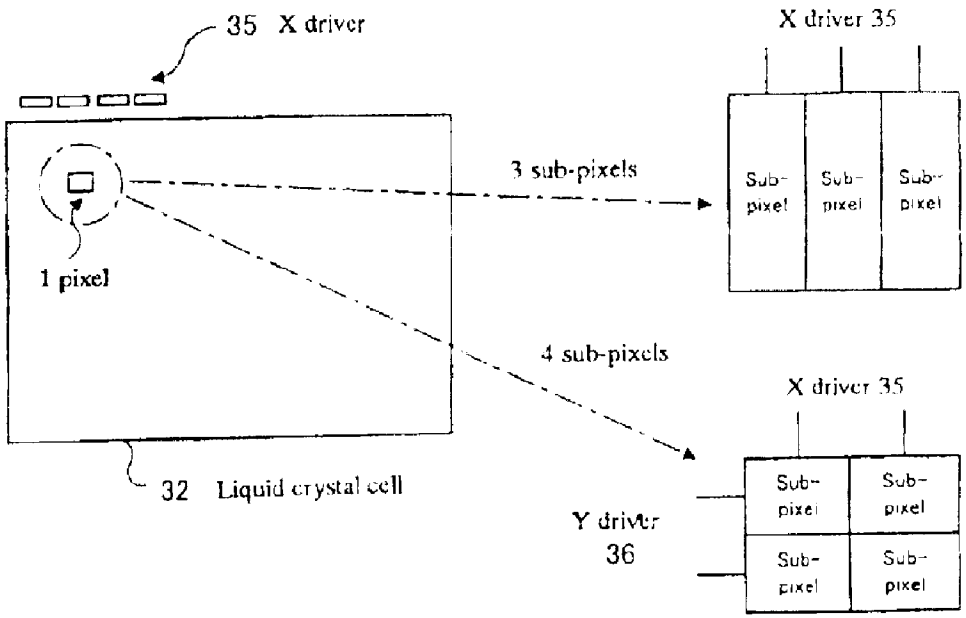

[Figure 4]
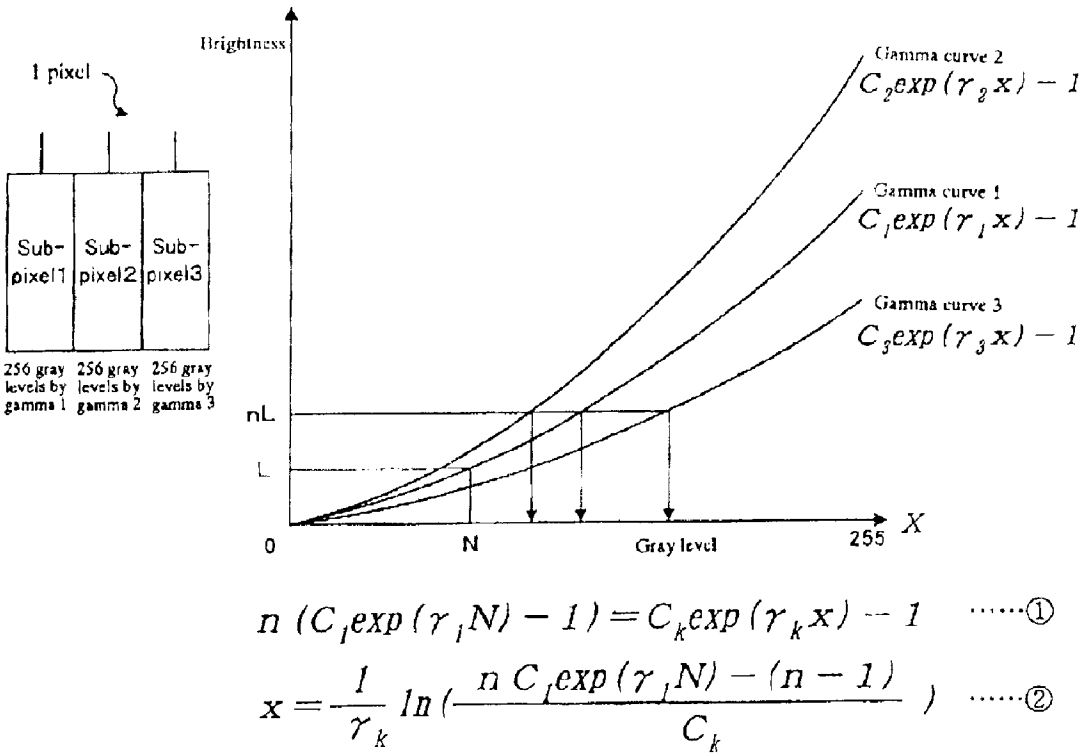
$$n\,(C_1 exp(\gamma_1 N) - 1) = C_k exp(\gamma_k x) - 1 \quad \cdots\cdots ①$$
$$x = \frac{1}{\gamma_k} \ln\left(\frac{n\,C_1 exp(\gamma_1 N) - (n-1)}{C_k}\right) \quad \cdots\cdots ②$$

[Figure 5]
(a) Adjustment of gamma by converting gray level spacing
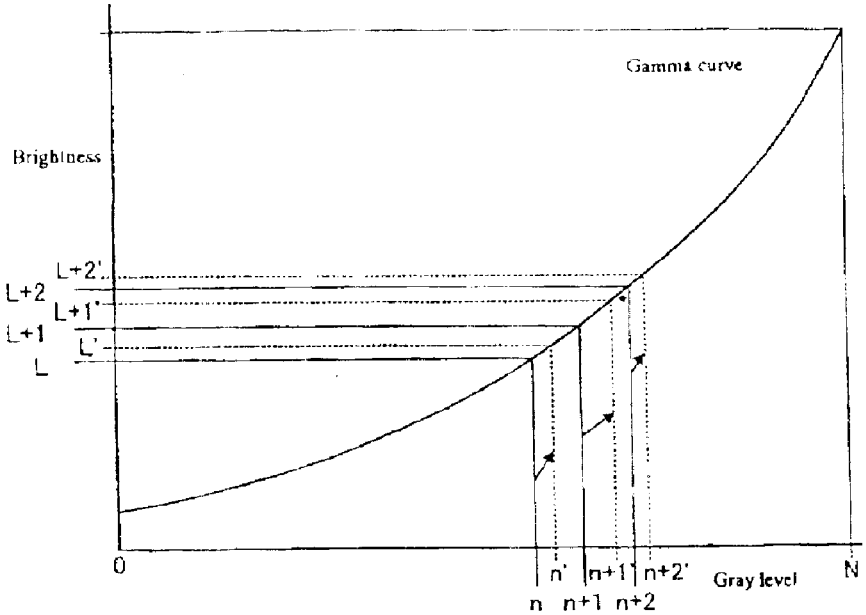
(b) Conversion of gray level spacing
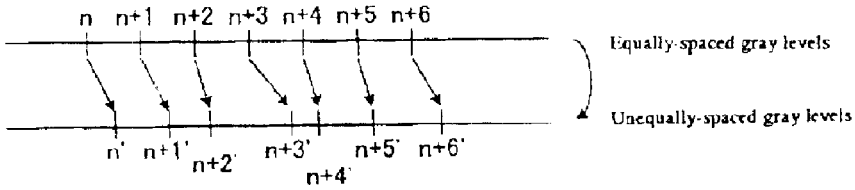

[Figure 6]

43 (First offset table)

| Gray levels | Offset |
|---|---|
| 255 | −2.xx |
| 223 | −2.xx |
| 191 | −3.xx |
| 159 | −2.xx |
| 127 | −2.xx |
| ... | ... |
| 32 | −1.xx |
| 0 | 0 |

44 (Third offset table)

| Gray levels | Offset |
|---|---|
| 255 | −4.xx |
| 223 | −4.xx |
| 191 | −5.xx |
| 159 | −3.xx |
| 127 | −3.xx |
| ... | ... |
| 32 | −1.xx |
| 0 | 0 |

[Figure 7]
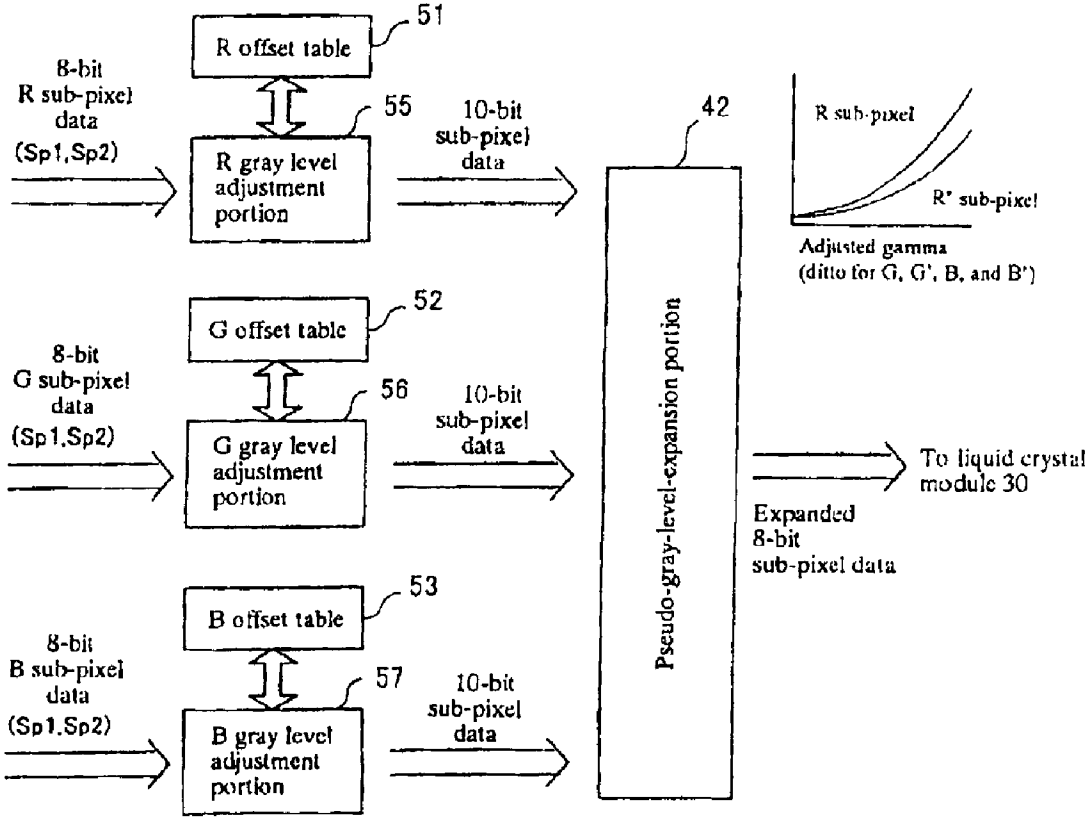

IMAGE DISPLAY APPARATUS AND METHOD THEREOF

BACKGROUND OF INVENTION

1. Field of the Invention

The present invention relates to a display technology for a liquid crystal display (LCD), in particular, to a method and apparatus for increasing the number of gray levels in a LCD.

2. Background Art

Today, the term "liquid crystal display (LCD)" may readily bring a color LCD display to mind. In fact, most LCD modules widely used for LCD monitors use an "8-bit color" source driver, which displays each of the colors, read (R), green (G), and blue (B), by using 8-bit data. By this technology, $2^8$=256 gray levels of each color can be represented, and therefore totally as much as $(2^8)^3$=16 M (approximately 16 million) colors can be represented by all of the R, G, and B.

On the other hand, applications of displays do not necessarily require color display capability. For some applications, a monochrome display is sufficient, or even, better than a color display to meet the demands for higher resolution and a larger number of gray levels. A good example is medical image displays used for x-ray. CRT monitors capable of displaying monochromes with higher resolution and more gray levels have been used conventionally in these special applications. Some monochrome CRT monitors can display 12-bit data, that is, data that can represent $2^{12}$ gray levels, supplied by the graphics adapter of a host system. To support such data, LCD displays are required to be able to represent that number of gray levels.

The market of these monochrome monitors is very attractive to the manufacturers of LCD modules/monitors. Today, LCD monitors can provide very high resolution, such as Quad Extended Graphics Array (QXGA: 2048×1536 dots) resolution and Quad Ultra Extended Graphics Array (QUXGA: 3200×2400 dots) resolution. Some LCD monitors even surpass CRT monitors in pixel pitches. For example, the pixel pitches of a 20.8-inch LCD monitor having QXGA are as follows:

in row: (4/5).20.8.25.4/2048=0.20637 in column: (3/5).20.8.25.4/1536=0.20637

Thus, the pitches are approximately 206 $\mu$m in both of the horizontal and vertical directions. This is too fine to the human eye for displaying characters (a pixel pitch of approximately 300 $\mu$m is said to be suitable for displaying characters), but best suited for displaying graphics.

As described above, the resolution of the LCD monitors is adequately high. However, the number of gray levels, which can be displayed by the LCD monitors, is very poor. For example, the number of gray levels displayable on a monochrome TFT monitor depends on the number of bits converted by the X-driver (digital-analog converter) of a LCD monitor. A monochrome TFT monitor using an 8-bit digital-analog converter can represent only 256 levels. Therefore, smoothly varying gray levels in a natural image are not always achieved. In particular, the number of gray levels of the LCD monitors is inadequate for applications, which require true gray scale images, such as the above-mentioned medical images (such as x-ray images).

Here, consider the case where a color Thin Film Transistor (TFT) LCD panel is made monochrome by simply removing its color filters (for example, by eliminating the color filter generation process). In that case, the number of gray levels representable by one pixel can be increased by treating three pixels corresponding to R, G, B as one monochrome pixel and combining the gray levels of these sub-pixels. In the case an 8-bit color image is made monochrome, when the gray level value of the three sub-pixels is changing from (m, m, m) to (m+1, m+1, m+1) (where, $0 \leqq m \leqq 2^8-1$), the sub-pixels can take two brightness levels, from (m, m, m+1) to (m, m+1, m+1). Here, (m, m, m+1), (m, m+1, m), and (m+1, m, m) are considered as the same brightness level and cannot be distinguished from each other. The same applies to (m, m+1, m+1), (m+1, m, m+1), and (m+1, m+1, m). Therefore, the number of representable gray levels is $3.(2^8)-2=766$.

This will be described below in detail. The gamma ($\gamma$: applied voltage (gray level) versus the transmittance of liquid crystal (brightness) of the sub-pixels, which is set by the X-driver of the LCD, can be changed by changing the reference voltage provided to the X-driver, which is a digital-analog converter. However, the gamma of each sub-pixel set by the X-driver cannot be individually changed because of limitations of the driver. Thus, the gammas of the sub-pixels will be the same. Here, assuming that the brightness of areas which was called R, G, B is N. Then, the gray levels of each of the R, G, B areas can be expressed as 0, N/255, 2N/255, . . . , 255N/255. By combining R, G, and B, gray levels of 0, N/255, 2N/255, . . . , 765N/255 can be represented. Thus, even if the color filter is removed from the color LCD panel and one pixel is represented by three sub-pixels to display monochrome images, the number of gray levels provided by an 8-bit color display device is at most 766, which is below $2^{10}$. Therefore, this approach cannot significantly increase the number of displayable gray levels.

The present invention is made in order to solve the above-mentioned problems and it is an object of the invention to increase the number of gray levels displayable on an LCD display without applying any optical arrangements such as filters to the surface of the LCD or increasing the number of bits provided by the X-driver (for example, eight bits) of the current LCD display.

Another object of the present invention is to allow an existing X-driver to be shared among sub-pixels without making any special changes to the gamma of the X-driver in order to increase the number of gray levels.

SUMMARY OF INVENTION

To achieve these objects, the present invention constructs one pixel with a plurality of sub-pixels and provides different gammas to these sub-pixels while using a common gamma provided by an existing LCD driver (X-driver), thereby allowing for displaying an image of a gray scale having a very large number of gray levels. Accordingly, a feature of the present invention provides a liquid crystal display apparatus for displaying an image on a liquid crystal cell through a liquid crystal driver driven by a predetermined number of bits by inputting image data in which one pixel is represented with a plurality of sub-pixels, wherein the liquid crystal display apparatus includes: memory for storing information about an offset for converting gray level coordinates of a gamma characteristic spaced evenly according to the number of bits into gray level coordinates spaced unevenly; a gray level adjustment portion for performing a calculation on particular input sub-pixel data based on information about the offset stored in the memory; and a pseudo-gray-level-expansion portion for applying pseudo gray level expansion to the sub-pixel data calculated by the gray level adjustment portion; wherein the sub-pixel data to which the pseudo gray level expansion is applied by the pseudo-gray-level-expansion portion is supplied to the liquid crystal driver to display the image on the liquid crystal cell.

Another feature of the present invention includes a monochrome liquid crystal display apparatus in that it comprises: a controller for outputting, from input monochrome data in which one pixel is represented with a plurality of sub-pixels, a gray level set for each of the plurality of sub-pixels; a liquid crystal cell for displaying a monochrome image; and a liquid crystal driver for supplying a voltage to the liquid crystal cell based on a gray level of the plurality of sub-pixels output from the controller without varying the liquid crystal transmittance for a particular gray level among the plurality of sub-pixels; wherein the controller assumes a characteristic in which no multiple of the brightness level of any intermediate gray level is identical to the brightness level of any intermediate gray level of another sub-pixel and selecting a gray revel which provides desired brightness from within the characteristic.

Still another feature of the present invention is characterized by a controller for providing image data for each of the plurality of sub-pixels to a liquid crystal driver supplying a voltage to a liquid crystal cell by inputting data in which one pixel is represented by a plurality of sub-pixels, wherein the controller includes: memory for storing information about an offset for converting gray level coordinates of a gamma characteristic spaced evenly according to the number of bits of the liquid crystal driver into gray level coordinates spaced unevenly; a gray level adjustment portion for performing a calculation on particular sub-pixel data based on information about the offset stored in the memory; and a pseudo-gray-level-expansion portion for applying pseudo gray level expansion to the sub-pixel data calculated by the gray level adjustment portion.

Yet another feature of the present invention provides an image conversion method for displaying an image on a liquid crystal cell by supplying a voltage through a liquid crystal driver based on input image data, wherein the method includes the steps of: inputting sub-pixel data in which one pixel of the image data is represented by a plurality of sub-pixels; and replacing the sub-pixel data with an appropriate gray level which provides a desired brightness selected from a higher density gray levels than a gray level representable with the number of bits in the liquid crystal driver in order to applying different gamma characteristics to each of the plurality of sub-pixels.

Still yet another feature of the present invention is an image conversion method characterized by inputting a plurality pieces of sub-pixel image data, each of the pieces of sub-pixel image data comprising N bits; assuming a second gamma characteristic corresponding to M bits (M>N) which is provided by adjusting a first gamma characteristic corresponding to N bits; selecting an appropriate gray level which provides desired brightness based on the second gamma characteristic for a particular piece of sub-pixel image data of the plurality pieces of sub-pixel image data and replacing its original gray level with the selected gray level; and providing the replaced gray level as an output value for the particular piece of sub-pixel image data. In this respect, a third gamma characteristic may be assumed.

Still another feature of the present invention includes an image display method for displaying a monochrome image having multiple gray levels by dividing one pixel into a plurality of sub-pixels, wherein the image display method characterized by: assuming a gamma characteristic of the sub-pixels in which no multiple of a brightness level of a intermediate gray level of the sub-pixel is identical to a brightness level of any intermediate gray level of another sub-pixel; selecting an appropriate gray level providing desired brightness based on the assumed gamma characteristic; and displaying the monochrome image based on the selected appropriate gray level.

Various other objects, features, and attendant advantages of the present invention will become more fully appreciated as the same becomes better understood when considered in conjunction with the accompanying drawings, in which like reference characters designate the same or similar parts throughout the several views.

BRIEF DESCRIPTION OF DRAWINGS

FIG. 1 is a drawing for explaining a general configuration of a liquid crystal display apparatus according to a first embodiment.

FIG. 2 is a functional block diagram for explaining features of the first embodiment.

FIG. 3 shows an exemplary configuration of sub-pixels according to the first embodiment.

FIG. 4 shows the gamma of each sub-pixel.

FIGS. 5(*a*), (*b*) show a drawing for explaining how gamma is adjusted by converting gray level spacing according to the first embodiment.

FIG. 6 shows the content of the first offset table 43 and the third offset table 44 stored in the memory 22 shown in FIG. 2.

FIG. 7 shows a functional block diagram for explaining features of a second embodiment.

DETAILED DESCRIPTION

The memory stores as a look-up table an offset value to be added to or subtracted from each gray level as a desired gamma characteristic for each sub-pixel to which gamma characteristic conversion is to be applied, and the offset value stored in the look-up table is a value represented with a higher density gray level using a larger number of bits than the number of bits of the liquid crystal driver. Furthermore, the pseudo-gray-level-expansion portion may be characterized in that it converts sub-pixel data which is converted by the gray level adjustment portion and has a larger number of bits than the number of bits of the liquid crystal driver into data which has the number of bits of the liquid crystal driver and is equivalent to data having the larger number of bits. By these configurations, an image having a very large number of gray levels can be displayed without making any substantial modification to an existing TFT liquid crystal display.

The controller may be characterized in that it outputs the gray level at the plurality of sub-pixels by using a gray level which fills the space between coordinates of gray levels spaced evenly on a given gamma characteristic cure, and may be characterized in that it outputs a gray level by using the given gamma characteristic for a particular sub-pixel of the plurality of sub-pixels and outputs a gray level based on a different gamma characteristic for other sub-pixels. By these configurations, a monochrome image comprising a gray scale having a very large number of gray levels can be displayed without any special modification to an LCD driver.

The liquid crystal display apparatus and monochrome liquid crystal display may be implemented, for example, as a liquid crystal display monitor separated from the casing of a computer system unit such as a personal computer (PC) unit, or may be implemented in the same casing as a PC such as a notebook PC. Any number and arrangement of sub-pixels may be used and the different gamma may be provided to any of the sub-pixels. Furthermore, the image data in which one pixel is represented with a plurality of sub-pixels may be generated in the liquid crystal display apparatus itself or in a system such as a PC/WS (workstation). These ideas may applicable to other inventions.

The controller may be provided as an interface board or may be implemented as an LSI into which various functions are integrated. Alternately, it may be integrated into the liquid crystal module.

The image conversion method may be characterized in that it comprises a step of pseudo-converting the sub-pixel data replaced with the appropriate gray level into data having the number of bits of the liquid crystal driver. The replacing step may be characterized in that it replaces the sub-pixel data with an appropriate gray level by using a gray level filling the space between gray levels of a basic gamma characteristic set based on the number of bits. By these configurations, a sub-pixel image equivalent to an image of a larger number of bits can be displayed and the image can be represented with a very large number of gray levels without increasing the number of bits supported by a liquid crystal driver.

The assumed gamma characteristic of the sub-pixels may be characterized in that it is provided by selecting an appropriate gray level which provides desired brightness from higher density gray levels between gray levels spaced evenly on a basic gamma characteristic curve set based on the number of bits of a liquid crystal driver and replacing their original gray level with the selected gray level. Furthermore, the method may be characterized in that one of the plurality of sub-pixels is displayed based on the basic gamma characteristic and the other sub-pixels are displayed based on the gamma characteristic provided by selecting an appropriate gray level providing desired brightness from higher density gray levels and replacing their original gray level with the selected gray level.

The present invention will be described below in detail with respect to an embodiment shown in the accompanying drawings.

FIG. 1 is a drawing for explaining a general configuration of a liquid crystal display apparatus of the embodiment. Reference number 10 denotes a liquid crystal display monitor (LCD monitor), which is a liquid crystal display panel, and comprises a liquid crystal module 30 having, for example, a thin film transistor (TFT) structure, and an interface (I/F) board 20 connected to a digital or analog interface to a personal computer (PC) or a workstation (WS) system for supplying a video signal to the liquid crystal module 30. If a notebook PC is used with this embodiment, a system unit (not shown) is attached to the liquid crystal display monitor 10 to form one unit.

The I/F board 20 has an Application Specific Integrated Circuit (ASIC) 21 including logic circuits for making various adjustments to the input video signal, memory 22 containing information required for the operation of the ASIC 21, and a microprocessor 23 for controlling the I/F board 20. The functions of these components may alternately be provided by a liquid crystal cell control circuit (which will be described below) in the liquid crystal module 30.

The liquid crystal module 30 consists of three main blocks: a liquid cell control circuit 31, liquid crystal cells 32, and a backlight 33. The liquid cell control circuit 31 consists of panel drivers such as an LCD controller LSI 34, a source driver (X-driver) 35, and a gate driver (Y-driver) 36. The X-driver 35 and the Y-driver 36 consist of a plurality of ICs. The LCD controller LSI 34 processes signals received from the I/F board 20 via a video interface and outputs appropriate signals to each ICs of the X-driver 35 and Y-driver 36 with an appropriate timing. The liquid crystal cells 32 output an image using a TFT array arranged in a matrix through the application of a voltage from the X-source driver 35 and the Y-driver 38. The backlight 33 has a fluorescent tube (not shown) lit up by an inverter power supply and is located behind or on the side of the LC cells 32 to illuminate the cells from behind. The backlight 33 is used in a "transparent liquid crystal module" and typically not used in a "reflective liquid crystal display module," which utilizes reflected ambient light as its light source.

Typically, RGB color filters are provided over the TFT liquid crystal cells 32 for color display. The RGB color filters are arranged (disposed) in a striped array, a mosaic array, or a delta (triangular) array and each TFT pixel corresponding to each RGB filter is divided into three sub-pixels and spatial modulation is applied to them to represent one pixel. However, in this embodiment, these color filters are eliminated from the liquid crystal cells 32 to form a monochrome TFT-LCD monitor.

FIG. 2 is a functional block diagram for explaining features of this embodiment. The ASIC 21 comprises a gray level adjustment portion 41 and a pseudo-gray-level-expansion portion 42 for performing gray scale expansion, such as dither/frame rate control (FRC). The memory 22 contains a first offset table 43 for storing an offset for a first sub-pixel and a third offset table 44 for storing an offset for a third sub-pixel.

The gray level adjustment portion 41 receives sub-pixel data, which is an 8-bit gray level, corresponding to the first, second, and third sub-pixels from the PC or WS system. After receiving the sub-pixel data, the gray level adjustment portion 41 applies a 10-bit precision offset to the first and third sub-pixels by referencing the first offset table 43 and the third offset table 44 contained in the memory 22. That is, offset values are stored in the form of a look-up table for each sub-pixel in the memory 22 which are added to or subtracted from each gray level value as a desired gamma ($\gamma$). The values in the first offset table 43 and the third offset table 44 are optimized so that the gamma curve of the first and third sub-pixels fit a desired exponential curve different from the gamma curve of the second sub-pixel, as will be described below.

The pseudo-gray-level-expansion portion 42 applies dithering or FRC to 10-bit sub-pixel data to which an offset is applied to convert it into expanded 8-bit data equivalent to more-than-eight-bit data, thereby allowing the data to be transferred to the panel drivers (the liquid crystal cell control circuit 31) supporting fewer bits (eight bits). That is, data which is adjusted based on a gamma adjusted for each sub-pixel is output to the liquid crystal module 30 as an expanded 8-bit sub-pixel data, as shown in FIG. 2.

The method for increasing the number of gray levels performed by the above-described arrangement will be described below in detail.

FIG. 3 shows exemplary configurations of sub-pixels of this embodiment. In this embodiment, the sub-pixels are configured in such a way that one pixel of the liquid crystal cell 32, which is a TFT LCD, can be represented a plurality of sub-pixels. For example, if one pixel is represented with three sub-pixels as shown in FIG. 3, the three sub-pixels are individually driven by the X-driver 35 of the LCD. The gamma of the sub-pixels set by the X-driver 35 may be common. One pixel may consist of any number of sub-pixels and any arrangement of the sub-pixels in one pixel may be used. For example, one pixel may consist of four sub-pixels as shown in FIG. 3. In that case, the four sub-pixels are driven by the X-driver 35 and the Y-driver 36 by "double scanning."

FIG. 4 shows the gamma of each sub-pixel. It is assumed that sub-pixels (p1, p2, p3, . . . , pn) make up one pixel, where n=3, for simplicity, and each sub-pixel is driven by the X-driver 35 supporting 8 bits. In this embodiment, the sub-pixels are arranged as shown in FIG. 4 and the gamma of each sub-pixel is set as shown in the figure. Gamma curve 1 corresponds to the first sub-pixel, gamma curve 2 corresponds to the second sub-pixel, and gamma curve 3 corresponds to the third pixel. Because the brightness levels of 256 gray levels of each sub-pixel are based on different gammas (gamma curves), it is ensured that no integer multiple of brightness level of any gray level (in the range 1–255) at any sub-pixel is identical to brightness level of any gray level (in the range 1–255 ) at any sub-pixel. In other words, the gamma curve only needs to fit well with an exponential curve.

Equations 1 and 2 shown in FIG. 4 explains the above-mentioned relationship. In Equation 1, a particular gray level (N) of gamma 1 multiplied by n equals gray level x of a particular gamma (gamma k). Equation 2 is the solution of Equation 1. As evident from Equation 2, the right-hand side of Equation 2 represents a function of an irrational number, therefore gray level x never takes an integer. That is, if each gamma is determined so as to approach a proper (accurate) gamma, it is ensured that no integer multiple of brightness level of any intermediate gray level at a particular sub-pixel is identical to brightness level of any intermediate gray level at any sub-pixel.

This relationship will be further considered below. Let permutation of numbers (N1, N2, N3) be the gray levels of sub-pixels constituting of the brightness level of one pixel. Then the following Equations $$(1, 0, 0)\neq(0, 1, 0)\neq(0, 0, 1)\neq(1, 0, 0) \quad (3)$$

$$(2, 0, 0)\neq(0, 1, 1) \quad (4)$$

and so on, are provided as can be easily seen from FIG. 4. Especially important is that Equation (3) indicates that "because different sub-pixels have different brightness levels even if their gray levels are the same, the brightness of one pixel is different from others if the coordinates of the number representing the gray level of the sub-pixel is different," and this is because a different gamma is provided for each sub-pixel.

If the current 8-bit driver 35 is used without increasing the number of bits supported by the X driver 35 and one pixel is constructed with n sub-pixels, the number of displayable gray levels of one pixel under the above-mentioned conditions will be:

$$(2^8)^n \quad (5)$$

If n=3, approximately 16 M gray levels can be represented.

FIGS. 5(*a*), (*b*) are drawings for explaining a method for adjusting gamma by converting gray level spacing according to the embodiment. The relationship between a gray level and the corresponding brightness is as shown in FIG. 5 (*a*). The horizontal scale indicates the gray levels spaced evenly. The gamma curve can be adjusted by changing brightness corresponding to each of these gray levels. As described earlier, the reference voltage setting cannot be changed individually for each sub-pixel by the X-driver 35 because of the limitations of the X-driver 35. A special modification to the X-driver 35 would be required in order to change the gamma of each sub-pixel by the driver but such a modification is not practical.

In this embodiment, as shown in FIG. 5(*b*), the coordinates of gray levels spaced evenly on the gamma curve of each sub-pixel are converted into the coordinates of gray levels spaced unevenly corresponding to a desired brightness different from brightness corresponding to the gray levels. That is, an appropriate gray level, which provides the desired brightness, is selected from gray levels of a higher density (for example, 10-bit, 1024 levels) which lies between 256 (for 8-bit data) gray levels spaced evenly and the original gray level is replaced with the selected level.

An original gamma is determined by the X-driver 35 in the liquid crystal module 30 as described earlier. In this embodiment, the original gamma determined by the X-driver 35 is applied to the second sub-pixel, which is the center of the three sub-pixels and the original gamma curve is adjusted so that a desired gamma of the first and third sub-pixels can be set. That is, the space between original gray levels is reduced by a factor of four so that the gray level can be changed in fourths of the original gray level. By this, arrangement, brightness L (n) corresponding to gray level n can be changed to L(n−0.75), L(n−0.5), L(n−0.25), L(n+0.25), L(n+0.5), or L(n+0.75), thus the gamma curve representing the relationship between each of the 256 gray levels (for 8-bit sub-pixel data) and the corresponding sub-pixel can be adjusted apparently. For example, if L(n+0.25) is selected, the brightness L(n) corresponding to gray level n can be changed to L (n+0.25).

FIG. 6 shows the content of the first offset table 43 and the third offset table 44 contained in the memory 22 described with respect to FIG. 2. An offset value to be added to or subtracted from each gray level value as a desired gamma is held in the form of a look-up table for each sub-pixel. According to the embodiment, the actual adjustment of gray levels is accomplished by applying a 10-bit precision offset to input 8-bit sub-pixel data (the gray level of each sub-pixel) in the case of the above-mentioned 8-bit sub-pixel data. That is, addition or subtraction is performed in increments of 0.25 in the range of 0.25 to 0.75 by the gray level adjustment portion 41 shown in FIG. 2 with reference to each offset table shown in FIG. 6. Offsets, −2.xx, −4.xx, and so on in the example shown in FIG. 6 are given with a precision of greater than 8 bits (for example 10 bits) if 8-bit input data is used. While in the example shown in FIG. 6 nine gray levels including the lowest gray level are extracted from 256 gray levels, any number of levels may be extracted.

The result of this calculation is 10-bit sub-pixel data. This 10-bit data is converted to 8-bit data equivalent to 10-bit data by applying pseudo gray level expansion such as dithering or FRC in the pseudo-gray-level-expansion portion 42 as described earlier before transferred to the X-driver 35 of the 8-bit liquid crystal module 30.

While increments of ¼ gray level is used in the example described above, increments of ⅛ gray levels may be used. In that case, the 11-bit data would be used instead of 10-bit data and the above-mentioned addition or subtraction would be performed in increments of 0.125 instead of 0.25.

In the embodiment, different gammas are provided for sub-pixels independently of settings of the X-driver 35 in the liquid crystal module 30, as described above. That is, the embodiment is configured so that a gamma provided by the X-driver 35 can be used in common among a plurality of sub-pixels, in addition different gammas can be provided for the plurality of sub-pixels by using intermediate gray scales between original gray levels. As a result, even though the common gamma provided by the X-driver 35 is used, it is ensured that no integer multiple of brightness level of any intermediate gray level at any sub-pixel is identical to the brightness level of any intermediate gray level at any sub-pixel. The number of gray levels can be dramatically increased by using a plurality of sub-pixels controlled in this way to form one pixel. Furthermore, this method can be implemented in a control LSI such as the I/F board 20 without applying any optical arrangements such as filters to the surface of the liquid crystal cell 32 and any special modification to LCD drivers such as the X-driver 35. Accordingly, an LCD providing a large number of gray levels can be provided with a minimum increase in cost.

In the first embodiment of the present invention, an approach for increasing the number of gray levels has been described with respect to a monochrome TFT LCD monitor as an example.

In a second embodiment of the present invention, an example for dramatically increasing the number of colors of a color LCD panel by applying this approach to the color LCD panel.

In the following description, components like those in Embodiment 1 will be denoted with like reference number and the detailed description thereof will be omitted.

FIG. 7 shows a function block diagram for explaining features of a second embodiment of the present invention. In this embodiment, each of the R, G, B sub-pixels constituting one pixel is further divided into two sub-pixels and different gammas are applied to the two sub-pixels. While in the first embodiment the first offset table 43 and the third offset table 44 are provided in the memory 22, an R offset table 51, a G offset table 52, and a B offset table 53 are provided in the memory 22 and offsets are provided by an R gray level adjustment portion 55, a G gray level adjustment portion 56, and a B ray level adjustment unit 57 in a gray level adjustment portion 41. The R offset table 51, G offset table 52, and B offset table 53 contain 10-bit precision offset values for each of the R, G, and B gammas. The R gray level adjustment portion 55, G gray level adjustment portion 56, and B gray level adjustment portion 57 calculate 10-bit sub-pixel values (the gray level of each sub-pixel) with reference to the offset values in each of the offset tables (51–53). The calculated values are converted into 8-bit data equivalent to 10-bit data by a pseudo-gray-level-expansion portion 42, then transferred to the liquid crystal module 30. RGB color filters (not shown) are provided in the liquid crystal cells 32 used in this embodiment.

The above-mentioned arrangement in the second embodiment allows different gammas to be provided for the two sub-pixels produced by dividing each of the R, G, and B sub-pixels. That is, as with the first embodiment, while a common gamma provided by the X-driver 35 is used, it is ensured that no integer multiple of brightness level of any intermediate gray level at the two sub-pixels of each color is identical to brightness level of any intermediate gray level at the two sub-pixels. As a result, the number of gray levels of each color can be increased and therefore the number of colors can be increased.

As described above, according to the embodiments an image having a large number of gray levels can be displayed without increasing the number of bits supported by the drivers.

To increase the number of gray levels, which can be represented on an LCD without applying any optical arrangements such as filters to the surface of the LCD panel or increasing the number of bits, supported by the X-driver.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is clamed is:

1. A liquid crystal display apparatus for displaying an image on a liquid crystal cell through a liquid crystal driver driven by a predetermined number of bits by inputting image data in which one pixel is represented with a plurality of sub-pixels, comprising:

memory for storing information about an offset for converting gray level coordinates of a gamma characteristic spaced evenly according to said number of bits into gray level coordinates spaced unevenly, so that the gray levels coordinates of at least one sub-pixel are spaced at a higher density between the gray level coordinates of another sub-pixel;

a gray level adjustment portion for performing a calculation on particular input sub-pixel data based on information about said offset stored in said memory; and a pseudo-gray-level-expansion portion for applying pseudo gray level expansion to said sub-pixel data calculated by said gray level adjustment portion, wherein said pseudo-gray-level-expansion portion converts sub-pixel data which is converted by said gray level adjustment portion and has a larger number of bits than said number of bits of said liquid crystal driver into data which has said number of bits of said liquid crystal driver and is equivalent to data having said larger number of bits, and wherein said sub-pixel data to which the pseudo gray level expansion is applied by said pseudo-gray-level-expansion portion is supplied to said liquid crystal driver to display the image on said liquid crystal cell, whereby the number of gray scale levels which can be displayed is increased.

2. The liquid crystal display apparatus according to claim 1, wherein said memory stores as a look-up table an offset value to be added to or subtracted from each gray level as a desired gamma characteristic for each sub-pixel to which gamma characteristic conversion is to be applied.

3. The liquid crystal display apparatus according to claim 2, wherein the offset value stored in said look-up table is a value represented with a higher density gray level using a larger number of bits than said number of bits of said liquid crystal driver.

4. A monochrome liquid crystal display apparatus, comprising:

a controller for outputting, from input monochrome data in which one pixel is represented with a plurality of sub-pixels, a gray level set for each of said plurality of sub-pixels;

a liquid crystal cell for displaying a monochrome image; and a liquid crystal driver for supplying a voltage to said liquid crystal cell based on a gray level of said plurality of sub-pixels output from said controller without varying the liquid crystal transmittance for a particular gray level among said plurality of sub-pixels, wherein a density of gray levels for at least one of said sub-pixels is greater than that of another of said sub-pixels, wherein said controller assumes a characteristic for the particular sub-pixel in which no multiple of the brightness level of any intermediate gray level is identical to the brightness level of any intermediate gray level of another sub-pixel and selecting a gray level which provides desired brightness from within said characteristic, and wherein said controller outputs a gray level by using a given gamma characteristic for a particular sub-pixel of said plurality of sub-pixels and outputs a gray level based on a different gamma Characteristic for other sub-pixels.

5. The monochrome liquid crystal display apparatus according to claim 4, wherein said controller uses a gray level which fills the space between coordinates of gray levels spaced evenly on a given gamma characteristic curve to output said gray level at said plurality of sub-pixels.

6. A controller for providing image data for each of a plurality of sub-pixels to a liquid crystal driver supplying a voltage to a liquid crystal cell by inputting data in which one pixel is represented by a plurality of sub-pixels, comprising:

memory for storing information about an offset for converting gray level coordinates of a gamma characteristic spaced evenly according to the number of bits of said liquid crystal driver into gray level coordinates spaced unevenly and at a higher density, said gray level coordinates spaced unevenly representing additional intensity levels to be displayed;

a gray level adjustment portion for performing a calculation on particular sub-pixel data based on information about said offset stored in said memory; and a pseudo-gray-level-expansion portion for applying pseudo gray level expansion to said sub-pixel data calculated by said gray level adjustment portion, wherein said controller outputs a gray level by using a given gamma characteristic for a particular sub-pixel of said plurality of sub-pixels and outputs a gray level based on a different gamma characteristic for other sub-pixels.

7. An image conversion method for displaying an image on a liquid crystal cell by supplying a voltage through a liquid crystal driver based on input image data, comprising the steps of:

inputting sub-pixel data in which one pixel of said image data is represented by a plurality of sub-pixels; and replacing said sub-pixel data with an appropriate gray level which provides a desired brightness selected from higher density gray levels than a gray level representable with the number of bits in said liquid crystal driver in order to apply different gamma characteristics to each of said plurality of sub-pixels, so as to increase the number of intensity levels displayed, wherein said replacing replaces said sub-pixel data with an appropriate gray level by using a gray level filling the space between gray levels of a basic gamma characteristic set based on said number of bits.

8. The image conversion method according to claim 7, further comprising a step of pseudo-converting said sub-pixel data replaced with said appropriate gray level into data having the number of bits of said liquid crystal driver.

9. An image conversion method, comprising the stops of:

inputting a plurality of pieces of sub-pixel image data, each of said pieces of sub-pixel image data comprising N bits;

assuming a second gamma characteristic corresponding to M bits (M>N) which is provided by adjusting a first gamma characteristic corresponding to N bits, at least a portion of said M bits representing gray levels at a higher density between gray levels represented by said N bits;

selecting an appropriate gray level which provides desired brightness based on said second gamma characteristic for a particular piece of sub-pixel image data of said plurality of pieces of sub-pixel image data and replacing its original gray level with the selected gray level; and providing said replaced gray level as an output value for said particular piece of sub-pixel image data, wherein said replacing replaces said sub-pixel data with an appropriate gray level by using a gray level filling the space between gray levels of a basic gamma characteristic set based on said number of bits.

10. An image display method for displaying a monochrome image having multiple gray levels by dividing one pixel into a plurality of sub-pixels, comprising the steps of:

assuming a gamma characteristic of said sub-pixels in which no multiple of a brightness level of an intermediate gray level of said sub-pixel is identical to a brightness level of any intermediate gray level of another sub-pixel, and wherein a density of gray levels for at least one of said sub-pixels is greater than that of another of said sub-pixels;

selecting an appropriate gray level providing desired brightness based on said assumed gamma characteristic; and displaying the monochrome image based on said selected appropriate gray level, wherein one of said plurality of sub-pixels is displayed based on said basic gamma characteristic and the other sub-pixels are displayed based on the gamma characteristic provided by selecting an appropriate gray level providing desired brightness from higher density gray levels and replacing their original gray level with the selected gray level.

11. The image display method according to claim 10, wherein said assumed gamma characteristic of said sub-pixels is provided by selecting an appropriate gray level which provides desired brightness from higher density gray levels between gray levels spaced evenly on a basic gamma characteristic curve set based on the number of bits of a liquid crystal driver and replacing their original gray level with the selected gray level.

12. The liquid crystal display apparatus according to claim 1, wherein no multiple of a brightness level of an intermediate gray level of one sub-pixel is identical to a brightness level of any intermediate gray level of another sub-pixel.

* * * * *